US007361312B2

(12) United States Patent
Takeda et al.

(10) Patent No.: US 7,361,312 B2
(45) Date of Patent: Apr. 22, 2008

(54) NOZZLE TIP FOR PIPETTING APPARATUS

(75) Inventors: Masaaki Takeda, Saitama (JP); Takayoshi Saito, Tokyo (JP)

(73) Assignee: Aloka Co., Ltd. (JP)

( * ) Notice: Subject to any disclaimer, the term of this patent is extended or adjusted under 35 U.S.C. 154(b) by 464 days.

(21) Appl. No.: 10/377,150

(22) Filed: Feb. 28, 2003

(65) Prior Publication Data

US 2003/0165408 A1 Sep. 4, 2003

(30) Foreign Application Priority Data

Mar. 1, 2002 (JP) ..... 2002-056182

(51) Int. Cl.
*B01L 3/02* (2006.01)

(52) U.S. Cl. ..... 422/100; 73/863.32; 73/864; 73/864.01

(58) Field of Classification Search ..... 422/99, 422/100, 931; 73/863.32, 864, 864.01
See application file for complete search history.

(56) References Cited

U.S. PATENT DOCUMENTS 4,267,729 A * 5/1981 Eddelman et al. ..... 73/864.02
4,347,875 A 9/1982 Columbus
4,917,274 A * 4/1990 Asa et al. ..... 222/420
4,931,257 A * 6/1990 Quenin et al. ..... 422/100
4,973,450 A * 11/1990 Schluter ..... 422/101
4,999,164 A * 3/1991 Puchinger et al. ..... 422/100
5,232,669 A 8/1993 Pardinas
5,334,348 A * 8/1994 Saito et al. ..... 422/61
5,487,997 A * 1/1996 Stolp ..... 436/54
5,874,048 A * 2/1999 Seto et al. ..... 422/100
6,066,297 A * 5/2000 Torti et al. ..... 422/100
6,286,678 B1 * 9/2001 Petrek ..... 206/443
6,343,717 B1 * 2/2002 Zhang et al. ..... 222/209
6,531,098 B1 * 3/2003 Kenney ..... 422/100
6,566,145 B2 * 5/2003 Brewer ..... 436/178
6,596,240 B2 * 7/2003 Taggart et al. ..... 422/100
6,635,201 B1 * 10/2003 Kopaciewicz et al. ..... 264/41
6,780,381 B2 * 8/2004 Yiu ..... 422/100
6,803,021 B1 * 10/2004 Bertling ..... 422/100
6,878,346 B2 * 4/2005 DeYoung et al. ..... 422/102
2002/0085958 A1 * 7/2002 Nemcek et al. ..... 422/102
2002/0086440 A1 * 7/2002 Lehtinen et al. ..... 436/180
2002/0094302 A1 * 7/2002 Taggart et al. ..... 422/100
2002/0143293 A1 10/2002 Francavilla et al.
2002/0164273 A1 * 11/2002 Harrop ..... 422/102
2003/0129089 A1 * 7/2003 Arnold et al. ..... 422/63

* cited by examiner

*Primary Examiner*—Brian R. Gordon
(74) *Attorney, Agent, or Firm*—Marger Johnson & McCollom, P.C.

(57) ABSTRACT

In an improvement of a nozzle tip for a pipetting apparatus which is adapted to be removably attached to a nozzle base of the pipetting apparatus, the nozzle tip includes a head portion having an opening adapted to fit onto the nozzle base, a cylindrical portion extending downward from the head portion, a tip portion provided on the lower side of the cylindrical portion and having a tip opening for aspirating and dispensing a liquid, the tip portion having a diameter smaller than the diameter of the cylindrical portion, and a step portion formed between the cylindrical portion and the tip portion. A plurality of fins are integrally formed from the lower end portion of the cylindrical portion to the peripheral surface of the tip portion through the step portion with the same spacing in a circumferential direction for making the insertion of the nozzle tip into an upper opening of a target container smoothly and for structurally reinforcing the step portion.

9 Claims, 3 Drawing Sheets

NOZZLE TIP FOR PIPETTING APPARATUS

BACKGROUND OF THE INVENTION

1. Field of the Invention

The present invention relates to a nozzle tip for a pipetting apparatus, and in particular to an improvement of the shape of the nozzle tip.

2. Description of the Prior Art

In a pipetting apparatus, a nozzle is constructed from a nozzle base of the pipetting apparatus and a nozzle tip removably attached to the nozzle base. This nozzle is used to aspirate and dispense a liquid such as a reagent or a sample or the like. The used nozzle tip is discarded as required, and then a new nozzle is attached to the nozzle base. Normally, the nozzle tip is manufactured as an integrally formed product made of a resin.

An example of a prior art nozzle tip is shown in FIG. 3. In this example, a nozzle tip 10 is constructed from a head portion 12, a cylindrical portion 14, a step portion 16 and a tip portion 18. The head portion 12 has an opening 12A adapted to fit onto a nozzle base 8 of a pipetting apparatus (not shown in the drawing), and has a shape having a diameter larger than the diameter of the cylindrical portion 14. The cylindrical portion 14 has a roughly straight shape, but strictly speaking there is some tapering. The tip portion 18 is formed with a tip opening (small hole) 18A from which a liquid is aspirated or dispensed, and has a tapered shape. The cylindrical portion 14 has a lower end portion 14A having a larger diameter than the diameter of an upper end portion 18B of the tip portion 18, so that a step is created at the connecting portion therebetween with having a somewhat round surface. Namely, a step portion 16 in the form of a chin-shaped projection is formed between the lower end portion 14A of the cylindrical portion 14 and the upper end portion 18B of the tip portion 18.

However, in the case where the above-described prior art nozzle tip 10 is used, when there is a relative positioning misalignment between the nozzle tip 10 and a target container 20 at the time the nozzle tip 10 is inserted into the target container 20, there is the possibility that the step portion 16, namely, the chin-shaped projection will make contact with or become stuck on a part of a peripheral edge of an upper opening 20A of the target container 20. In such a case, since the peripheral surface of the step portion 16 forms a relatively steep inclined surface with respect to the central axis of the nozzle, there is the problem that it becomes difficult to smoothly insert the cylindrical portion 14 inside the target container 20. This problem can also occur in the same manner in the case when unused nozzle tips are set in a nozzle rack. In addition to the above problems since the tip portion 18 of the nozzle tip 10 generally has a thin thickness, there is a demand that such a portion of the nozzle tip 10 should be structurally reinforced.

SUMMARY OF THE INVENTION

Accordingly, it is an object of the present invention to provide a nozzle tip which can be smoothly inserted inside a target container even in the case where the nozzle tip makes contact with a part of a peripheral edge of the upper opening of the target container.

It is another object of the present invention to structurally reinforce the tip portion of the nozzle tip.

In order to achieve these objects, the present invention is directed to an improved nozzle tip for a pipetting apparatus which is adapted to be removably attached to a nozzle base of the pipetting apparatus. The nozzle tip comprises a head portion having an opening adapted to fit onto the nozzle base; a cylindrical portion extending downward from the head portion, the cylindrical portion having a lower end portion; a tip portion provided on the lower side of the cylindrical portion and having a tip opening for aspirating and dispensing a liquid, the tip portion having a diameter smaller than the diameter of the cylindrical portion, and the tip portion having a peripheral surface; a step portion formed between the cylindrical portion and the tip portion, the step portion forming a step-like part between the cylindrical portion and the tip portion; and at least one radially extending part which is provided from the lower end portion of the cylindrical portion to the peripheral surface of the tip portion through the step portion.

According to the above structure, the radially extending part is formed from the lower end portion of the cylindrical portion to the peripheral surface of the tip portion through the step portion (that is, at least on the step portion and its vicinity). Therefore, by appropriately setting the shape of the radially extending part, it is possible to exhibit desired functions such as a guiding function upon insertion into a container and a reinforcing function to the step portion. Here, it is to be noted that the radially extending part may be in the form of a fin, a protrusion, a rib or the like. Further, it is preferred that the radially extending part is formed into a substantially triangle shaped plate extending along the axial direction of the nozzle, but other shapes may be acceptable.

Preferably, the at least one radially extending part is formed into at least one fin extending along the axial direction of the nozzle. When taking removability from a die in an injection molding process or a slope function-of the fin into account, it is preferred that the fin extends along the axial direction of the nozzle.

Preferably, the fin has an upper end and a lower end, and the fin has a shape that its height in the radial direction is gradually lowered from the upper end toward the lower end thereof. In this arrangement, It is preferred that the upper end of the fin is level with the outer periphery of the lower end portion of the cylindrical portion, and the lower end of the fin is level with the outer periphery of the intermediate portion of the tip portion.

According to the above structure, the upper surface of each fin, that is the ridge surface of each fin, forms a gentle slope. This gentle slope of the ridge surface of each fin exhibits guiding function to moderate an impact upon contact of the step portion of the nozzle tip with a part of a peripheral portion of an upper opening of a target container, when the nozzle tip is inserted into the target container. Further, unfavorable contact between the nozzle tip and the container can be prevented in advance. In this connection, it is to be noted that generally such a container is held in a supporting opening in a container rack, and a slight gap is existed between the inner edge of the opening and the container (e.g. 1 to 2 mm). Therefore, when the nozzle tip contacts with the target container, it possible for the container to slightly change its posture or position with respect to the rack to absorb the positional misalignment. Alternatively, the position of the nozzle tip in a horizontal direction may be changed or controlled appropriately. Furthermore, the provision of such a fin also makes it possible to smoothly insert the nozzle tip into a tip receiving hole of a tip rack for setting the tip thereon.

More preferably, the at least one fin includes a plurality of fins formed around the axis of the nozzle through the same angular spacing. In this case, it is preferred that the number of the plurality of fins is any one of three to eight. According to this arrangement, the above described guiding function can be exhibited even in the case where any circumferential part of the tip part of the nozzle tip contacts with any part of the peripheral edge of the upper opening of the target container.

Preferably, the nozzle tip is an integrally molded resin product.

Further, another aspect of the present invention is directed to an improved nozzle tip for a pipetting apparatus which is adapted to be removably attached to a nozzle base of the pipetting apparatus. The improved nozzle tip comprises a head portion having an opening adapted to fit onto the nozzle base; a cylindrical portion extending downward from the head portion, the cylindrical portion having a lower end portion; a tip portion provided on the lower side of the cylindrical portion and having a tip opening for aspirating and dispensing a liquid, the tip portion having a diameter smaller than the diameter of the cylindrical portion, and the tip portion having a peripheral surface; a step portion formed between the cylindrical portion and the tip portion, the step portion forming a step-like part between the cylindrical portion and the tip portion; and guide means for guiding the cylindrical portion into an upper opening of a target container, the guide means being provided from the lower end portion of the cylindrical portion to the peripheral surface of the tip portion through the step portion.

Furthermore, yet another aspect of the present invention is directed to an improved nozzle tip for a pipetting apparatus which is adapted to be removably attached to a nozzle base of the pipetting apparatus. The nozzle tip comprises a head portion having an opening adapted to fit onto the nozzle base; a cylindrical portion extending downward from the head portion, the cylindrical portion having a lower end portion; a tip portion provided on the lower side of the cylindrical portion and having a tip opening for aspirating and dispensing a liquid, the tip portion having a diameter smaller than the diameter of the cylindrical portion, and the tip portion having a peripheral surface; a step portion formed between the cylindrical portion and the tip portion, the step portion forming a step-like part between the cylindrical portion and the tip portion; and reinforcing means for reinforcing the tip portion, the reinforcing means being provided from the lower end portion of the cylindrical portion to the peripheral surface of the tip portion through the step portion.

Hereinbelow, comparative examples that are conceivable will be discussed for the purpose of making the feature of the present invention clearer.

In order to prevent or reduce the possibility that the step portion contacts with the peripheral edge of the upper opening of the target container, there is an approach that the outer diameter of the cylindrical portion (in particular, the outer diameter of the lower end portion thereof) is formed to have a reduced diameter so that the inclined angle of the surface of the step portion becomes gently. However, this approach involves a problem in that the internal volume of the nozzle tip is decreased.

On the other hand, in order to make the inclined angle of the inclined surface of the step portion gently, there is an approach in that the tip portion is formed to have a large cone angle or the tip portion is formed to have a shorter length (by lengthening the step portion). However, according to these approaches, there is a problem in that an inner diameter of a liquid passage formed in the tip portion is increased or the axial length of the liquid passage is shortened, which may result in significant problems in the pipetting operations. For example, in the case where the narrow liquid passage in the tip portion is excessively shortened, an unfavorable phenomenon that a liquid is spouted out (fountained) inside the cylindrical portion due to abruptly increased flow rate of the liquid upon aspiration is likely to occur, and pressure adjustment upon dispensing the liquid becomes difficult, thus leading to the case that it is not difficult to pipette the liquid accurately. Furthermore, liquid leakage is likely to occur in the state that the inside of the nozzle tip is filled with the liquid. Moreover, in these pipetting apparatuses, there is an apparatus having a function capable of detecting a liquid surface in a nozzle tip, in which the detection is carried out by scanning a beam against the nozzle tip. In this type of apparatus, it is not possible to carry out surface detection for the liquid of which liquid surface is present in the liquid passage in the tip portion of the nozzle tip, since the nozzle tip has a smaller diameter than the cylindrical portion. For this reason, in order to reduce the possibility that liquid surface is present in the liquid passage in the tip portion, the internal volume of the liquid passage within the tip portion should be made as small as possible.

In addition to the above, in order to make the inclined angle of the inclined surface of the step portion gently, there is another approach in that the step portion is formed so as to have an increased thickness by using additional material. However, according to this approach, a raw material is unnecessarily consumed, and dimensional error at molding is likely to occur in the increased thickness part of the step portion, and crack is also likely to be formed at the increased thickness part. For these reasons, this approach involves various demerits and thus it is not practical.

According to the present invention, it is possible to enjoy the advantages such smooth insertion and reinforced structure and the like by the provision of the radially extending parts or fins, while solving the above mentioned problems.

DETAILED DESCRIPTION OF THE PREFERRED EMBODIMENTS

The preferred embodiment of the present invention will be described below with reference to the appended drawings.

Figure 1:
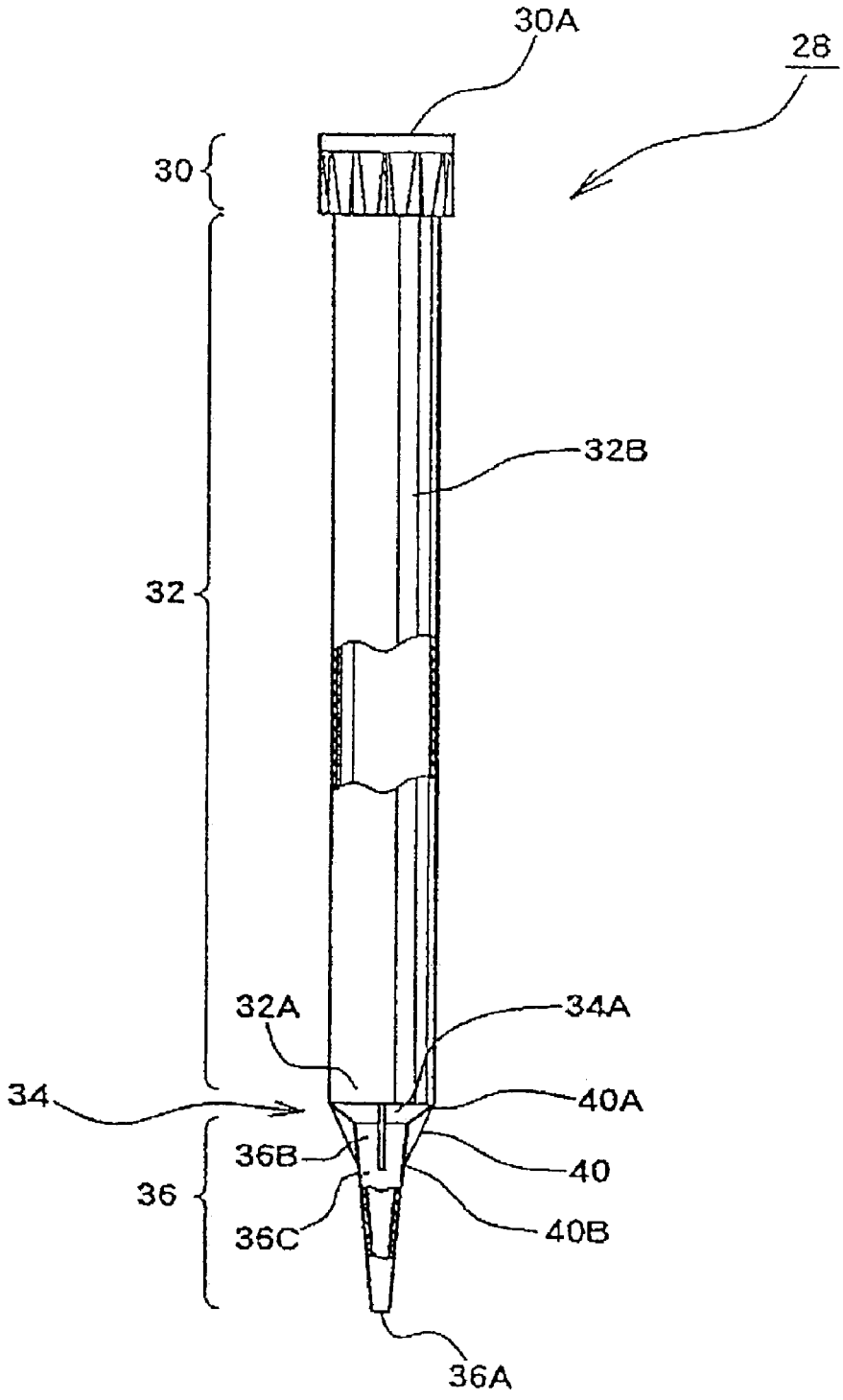
FIG. 1 is a side view which shows a preferred embodiment of a nozzle tip according to the present invention.

FIG. 1 is a side view which shows the preferred embodiment of the nozzle tip according to the present invention. This nozzle tip is a disposable-type nozzle tip which is removably attached to a nozzle base in a pipetting apparatus (not shown in the drawing).

As shown in FIG. 1, a nozzle tip 28 has a head portion (tip head) 30, a cylindrical portion 32, a step portion 34 and a tip portion 36 which are arranged from top to bottom. Each portion is continuous with the other portions, namely, the nozzle tip 28 is an integrally formed product made from a transparent resin. Further, a hollow passage is axially formed from top to bottom.

The head portion 30 has an opening 30A adapted to fit onto a nozzle base of a pipetting apparatus (not shown in the drawing) Further a plurality of ridges are formed on the peripheral surface of the head portion 30, and the diameter of the head portion 30 is larger than the diameter of an upper end portion 32B of the cylindrical portion 32.

The cylindrical portion 32 is formed into a roughly elongated straight cylindrical shape as a whole, but in actuality the cylindrical portion 32 is tapered so that the peripheral surface thereof has a tapering angle of 1 degree, for example.

The tip portion 36 has a tapered shape, and a tip opening 36A for aspirating and dispensing a liquid is formed at the lower end of the tip portion 36. As shown in the drawings, a lower end portion 32A of the cylindrical portion 32 has a larger diameter than an upper end portion 36B of the tip portion 36, so that a step portion 34 is formed between the lower end portion 32A of the cylindrical portion 32 and the upper end portion 36B of the tip portion 36. The peripheral surface of the step portion 34 is formed into a steep inclined surface inclined with respect to the central axis of the nozzle tip 28.

Figure 2:
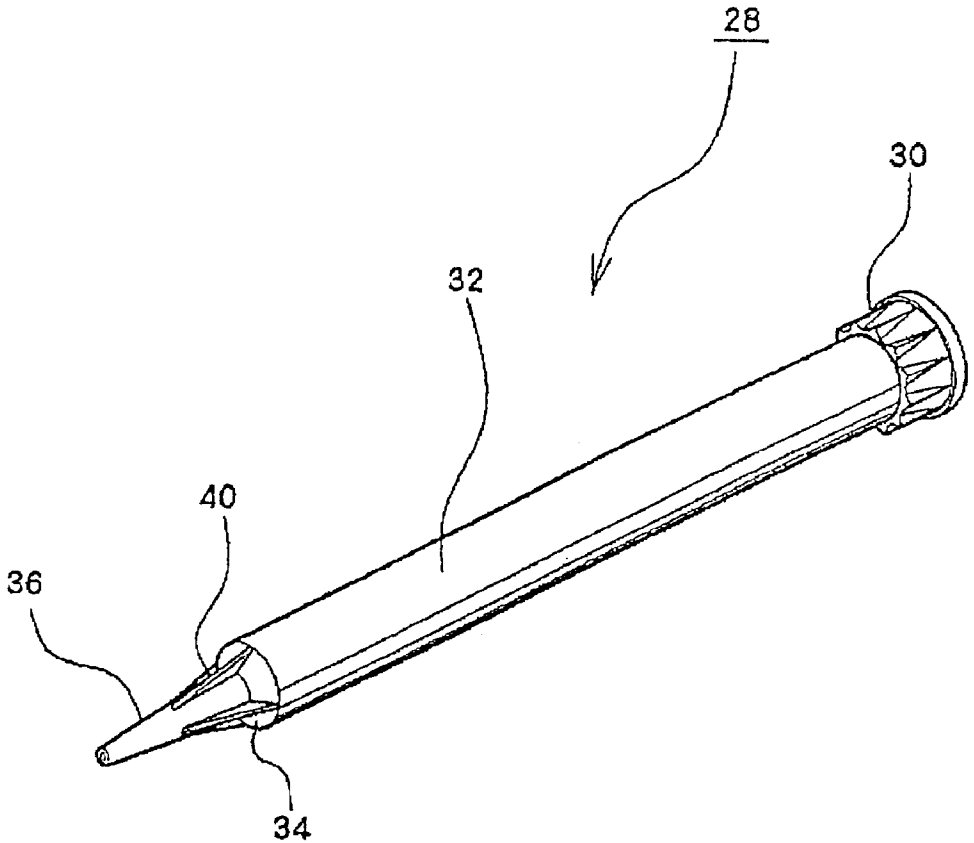
FIG. 2 is a perspective view of the nozzle tip shown in FIG. 1.
Figure 3:
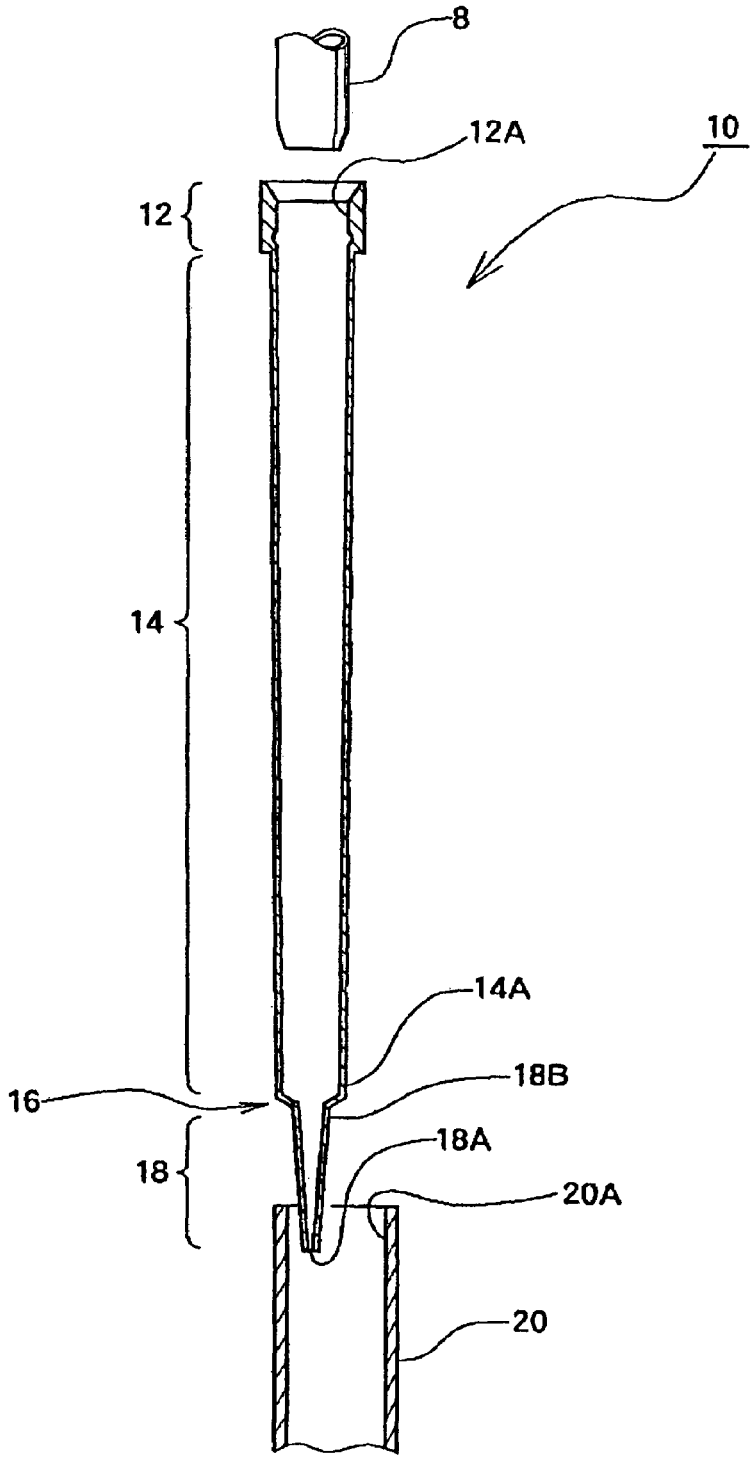
Fig. 3 (Prior Art)
FIG. 3 is a cross-sectional view which shows the prior art nozzle tip.

In the present embodiment, as shown in FIGS. 1 and 2, a plurality of fins 40 which protrude radially outward are formed from the lower end portion 32A of the cylindrical portion 32 to an intermediate portion 36C of the tip portion 36 through (over) the step portion 34. These fins 40 are arranged at the same angle around the central axis of the nozzle tip 28. In the example shown in FIG. 1, four fins 40 are formed at angular spacings of 90 degrees. These fins 40 constitute at least one protruding portion as claimed. Further, these fines also constitute guide means or reinforcing means as claimed.

As shown in the drawings, the fins 40 function as sloping plates to moderate the inclined surface of the step portion 34. Each of the fins 40 has a rough triangular shape. Each fin 40 has an upper end 40A which is level with the peripheral surface of the lower end portion 32A of the cylindrical portion 32. Further, a lower end portion 40B of each fin 40 is level with the peripheral surface of the intermediate portion 36C of the tip portion 36.

FIG. 2 shows a perspective view of the nozzle tip 28 shown in FIG. 1. As described above, four fins 40 which extend in the axial direction of the nozzle tip 28 are formed on the step portion 34 and the tip portion 36, but the present invention is not limited to this arrangement, and it is of course possible to provide any number of fins 40. Preferably, the number of fins 40 provided is three to eight.

When each portion shown in FIG. 1 is measured for the sake of reference, the lower end portion 32A of the cylindrical portion 32 has an inner diameter of 6.4 mm and an outer diameter of 8 mm, for example. Further, the upper end portion 36B of the tip portion 36 has an inner diameter of 3 mm and an outer diameter of 4.6 mm, for example. Further, the angle formed by the peripheral surface of the tip portion 36 with respect to the central axis of the nozzle tip 28 is 13 degrees, for example, and the angle formed by the upper surface of each fin 40, namely, the ridge surface of each fin 40 with respect to the central axis of the nozzle tip 28 is 20 degrees, for example. The thickness of each fin 40 is 0.5 mm, for example. However, these values given above only represent one possible example, and it is of course possible to use any desired values.

As described above, the nozzle tip 28 shown in FIG. 1 and FIG. 2 have a plurality of fins 40 provided on the step portion 34 and its vicinity Therefore, even in the case where it appears that a peripheral edge of an upper opening of a target container will make contact with the step portion 34 due to misalignment therebetween or the like, a part of the peripheral edge of the upper opening will actually come into contact with at least one of the ridge surfaces of the fins 40. Then, because such ridge surfaces are formed as inclined surfaces each having an easier or gentle slope than the inclined surface of the step portion 34, the cylindrical portion 32 can be smoothly guided inside the target container. Of course, such an unfavorable contact between this kind of nozzle tip and the target container does not occur frequently. However, in the case where such unfavorable contact does occur, the function of the fins 40 makes it possible to smoothly insert the nozzle tip 28 into the target container.

Further, even though the tip portion 36 is formed to have a relatively thin thickness, the plurality of fins 40 also function as reinforcing ribs (that is, the reinforcing means as claimed), thus It becomes possible to reinforce the structure of the tip portion 36. For example, the plurality of fins 40 make it possible to prevent the central axis of the tip portion 36 from being slightly bent when an external force or the like is exerted thereto.

Further, in a molding process for manufacturing the nozzle tip, such plurality of fins 40 contribute to significantly reducing molding errors of the tip portion 36. Furthermore, as compared with the case where the entire step portion 34 is made thick, it is possible to reduce the cost for material because a gap 34A is provided between the adjacent fins 40. Further, it is also possible to prevent problems such as dimensional distortion, breakage and the like which would occur in the case where the step portion 34 is made thick.

As described above, the present invention provides a nozzle tip which can be smoothly inserted inside a target container. Further, the present invention also makes it possible to reinforce the structure of the tip portion of the nozzle tip.

Finally, it is to be noted that the present invention is not limited to the above-mentioned embodiment, and it goes without saying that various changes and modifications may be made without departing from the scope of the present invention which is determined by the following claims.

What is claimed is:

1. A disposable-type nozzle tip for use in a pipetting apparatus for aspirating and/or dispensing a liquid such as a reagent or a sample from and/or to a target container through an upper opening of the target container, the nozzle tip being adapted to be removably attached to a nozzle base of the pipetting apparatus, which comprises:

a head portion having a plurality of ridges and an opening adapted to fit onto the nozzle base;

a cylindrical portion extending downward from the head portion, the cylindrical portion having a lower end portion;

a tip portion connected to the lower end portion of the cylindrical portion and having a liquid passage and a tip opening for aspirating and dispensing a liquid in a container, the tip portion having a diameter which is smaller than the diameter of the cylindrical portion;

a step portion formed at an interface between the cylindrical portion and the tip portion so as to have a step-like form, wherein the step portion forms a bottom surface of the lower end portion of the cylindrical portion; and a plurality of fins, each fin including a ridge surface, said fins are provided on the bottom surface of the lower end portion of the cylindrical portion and extend downward along the peripheral surface of the tip portion up to a substantially intermediate portion thereof, the intermediate portion having a diameter less than a diameter of a bottom end of the tip portion, and the fins being spaced around the axis of the nozzle with substantially the same angular spacing therebetween, wherein an upper end of a ridge surface of each fin is level with a peripheral surface of the lower end portion of the cylindrical portion, and a lower end of the ridge surface of each fin is level with a peripheral surface of the intermediate portion of the tip portion, and wherein the plurality of fins function to guide the cylindrical portion into an opening of the container when the nozzle tip which is attached to the nozzle base is inserted into the container and to reinforce the tip portion, wherein the tip portion is tapered toward a tip thereof so that a peripheral surface of the tip portion is formed into a first inclined guide surface having a first angle which is defined by the central axis of the nozzle tip and the peripheral surface of the tip portion in the anti-clockwise direction and extending between the intermediate portion and the tip opening of the tip portion, and the ridges surfaces of the fins form a second inclined guide surface having a second angle which is defined by the central axis of the nozzle tip and one of the ridge surfaces of the fins in the anti-clockwise direction and which is larger than the first angle of the first inclined guide surface, wherein the first inclined guide surface has a sufficient length along the longitudinal direction of the nozzle tip with respect to a length of the second inclined guide surface so that these inclined guide surfaces can cooperatively exhibit the guiding function in a two stepwise manner when the nozzle tip is inserted into the target container through the upper opening in a misaligned posture, wherein the two stepwise guiding function includes a first guide function which corrects the misaligned posture to a certain degree with the sliding contact between the first inclined guide surface and the edge of the upper opening of the target container and a second guide function which corrects the misaligned posture to a greater degree with the sliding contact between the second inclined guide surface and the edge of the upper opening of the target container, in which the first guide function and the second guide function are performed in a continuous manner according to the insertion of the nozzle tip into the target container; and wherein each fin has a substantially triangular plate-like shape having a thickness thinner than the diameter of the tip portion at the intermediate portion thereof and the fins are structured on the tip portion so that spaces are formed between the adjacent fins through which the outer periphery of the tip portion is exposed, and wherein at least the tip portion is composed of a resin material of the type through which changes of a liquid surface level in the liquid passage can be observed through the exposed outer periphery of the tip portion when aspirating and dispensing the liquid through the liquid passage.

2. The disposable-type nozzle tip as claimed in claim 1, wherein an inner surface of the liquid passage in the tip portion is continuously tapered toward the tip thereof such that the diameter of the tip opening is less than a diameter of any other portion of the tip portion.

3. The disposable-type nozzle tip as claimed in claim 1, wherein the first angle is about 13 degrees and the second angle is about 20 degrees.

4. The nozzle tip for a pipetting apparatus as claimed in claim 3, wherein the number of the plurality of fins is any one of three to eight.

5. The nozzle tip for a pipetting apparatus as claimed in claim 1, wherein the nozzle tip is a unitary resin product.

6. The nozzle tip for a pipetting apparatus as claimed in claim 1, wherein the nozzle tip is composed of a transparent resin material.

7. A disposable-type nozzle tip for use in a pipetting apparatus for aspirating and/or dispensing a liquid such as a reagent or a sample and/or to a target container through an upper opening of the target container, the nozzle tip being adapted to be removably attached to a nozzle base of the pipetting apparatus, which comprises:

a head portion having a plurality of ridges and an opening adapted to fit onto the nozzle base;

a cylindrical portion extending downward from the head portion, the cylindrical portion having a lower end portion;

a tip portion connected to the lower end portion of the cylindrical portion and having a liquid passage and a tip opening for aspirating and dispensing a liquid in a container, the tip portion having a diameter which is smaller than the diameter of the cylindrical portion;

a step portion formed at an interface between the cylindrical portion and the tip portion so as to have a step-like form, wherein the step-like part forms a bottom surface of the lower end portion of the cylindrical portion; and a plurality of fins, each fin including a ridge surface, said fins are provided on the bottom surface of the lower end portion of the cylindrical portion and extend downward along the peripheral surface of the tip portion up to a substantially intermediate portion thereof, the intermediate portion having a diameter less than a diameter of a bottom end of the tip portion, and the fins being spaced around the axis of the nozzle with substantially the same angular spacing therebetween, wherein each fin has a substantially triangular plate-like shape so that an upper end of a ridge surface of each fin is level with a peripheral surface of the lower end portion of the cylindrical portion, and a lower end of the ridge surface of each fin is level with a peripheral surface of the intermediate portion of the tip portion, and wherein the plurality of fins function to guide the cylindrical portion into an opening of the container when the nozzle tip which is attached to the nozzle base is inserted into the container and to reinforce the tip portion, wherein the tip portion is tapered toward a tip thereof so that a peripheral surface of the tip portion is formed into a first inclined guide surface having a first angle which is defined by the central axis of the nozzle tip and the peripheral surface of the tip portion in the anti-clockwise direction and extending between the intermediate portion and the tip opening of the tip portion, and the ridge surfaces of the fins form a second inclined guide surface having a second angle which is defined by the central axis of the nozzle tip and one of the ridge surfaces of the fins in the anti-clockwise direction and which is larger than the first angle of the first inclined guide surface, wherein the first inclined guide surface has a sufficient length along the longitudinal direction of the nozzle tip with respect to a length of the second inclined guide surface so that these inclined guide surfaces can cooperatively exhibit the guiding function in a two stepwise manner when the nozzle tip is inserted into the target container through the upper opening in a misaligned posture.

8. The disposable-type nozzle tip as claimed in claim 1, wherein the first inclined guide surface is longer along the longitudinal direction of the nozzle tip than the second inclined guide surface.

9. The disposable-type nozzle tip as claimed in claim 7, wherein the first inclined guide surface is longer along the longitudinal direction of the nozzle tip than the second inclined guide surface.

* * * * *